US008245470B2

(12) United States Patent
Bathon et al.

(10) Patent No.: US 8,245,470 B2
(45) Date of Patent: Aug. 21, 2012

(54) WOOD-CONCRETE-COMPOSITE SYSTEMS

(76) Inventors: Tobias Bathon, Graz (AT); Leander Bathon, Glattbach (AT)

( * ) Notice: Subject to any disclaimer, the term of this patent is extended or adjusted under 35 U.S.C. 154(b) by 0 days.

(21) Appl. No.: 11/840,244

(22) Filed: Aug. 17, 2007

(65) Prior Publication Data

US 2008/0016803 A1 Jan. 24, 2008

Related U.S. Application Data

(63) Continuation of application No. 10/970,574, filed on Oct. 21, 2004, now abandoned.

(30) Foreign Application Priority Data

Oct. 23, 2003 (DE) ..... 203 16 376 U
Nov. 7, 2003 (DE) ..... 103 51 989

(51) Int. Cl.
*E04C 2/292* (2006.01)
*E04B 5/23* (2006.01)

(52) U.S. Cl. ..... 52/309.16; 52/414; 52/334

(58) Field of Classification Search ..... 52/414, 52/796.1, 309.11, 309.12, 309.14, 309.16, 52/309.17, 327, 334, 336
See application file for complete search history.

(56) References Cited

U.S. PATENT DOCUMENTS 1,084,276 A * 1/1914 Jaminet ..... 52/514
1,183,594 A * 5/1916 Robinson ..... 264/32
1,235,636 A * 8/1917 Bagnall et al. ..... 52/326
2,239,177 A * 4/1941 Jorgen ..... 52/331
2,268,311 A * 12/1941 Sheehan ..... 52/339
2,435,998 A * 2/1948 Cueni ..... 52/223.8
3,286,418 A * 11/1966 Radford ..... 52/223.6
3,389,521 A * 6/1968 Gregori ..... 52/309.12
3,442,058 A * 5/1969 Naslund et al. ..... 174/482
3,446,692 A * 5/1969 Turnbull ..... 428/120
3,605,366 A * 9/1971 Zakim ..... 52/378
3,938,292 A * 2/1976 Kawasaki et al. ..... 52/741.13
3,956,864 A * 5/1976 Fung ..... 52/414
5,497,595 A * 3/1996 Kalinin ..... 52/836
5,561,957 A * 10/1996 Gauthier ..... 52/334
5,809,722 A * 9/1998 Bertsche ..... 52/334
6,094,878 A * 8/2000 Schluter ..... 52/323
6,105,321 A * 8/2000 KarisAllen et al. ..... 52/223.8
6,119,422 A * 9/2000 Clear et al. ..... 52/309.8
6,305,135 B1 * 10/2001 Inaba ..... 52/309.12

(Continued)

FOREIGN PATENT DOCUMENTS

CH 687 213 10/1996

(Continued)

OTHER PUBLICATIONS

Machine translation of DE 19808208.*

(Continued)

*Primary Examiner* — Christine T Cajilig
(74) *Attorney, Agent, or Firm* — Da Vinci Partners LLC

(57) ABSTRACT

A wood concrete composite system (100, 200) has a wood construction component (110, 111, 112, 210, 211), an intermediate layer (140, 141, 142, 143, 230, 231, 232) and a concrete construction unit (150, 151, 152, 240, 241). The concrete construction unit (150, 151, 152, 240, 241) has at least one side which faces the wood construction component (110, 111, 112, 210, 211). Thus at least single intermediate layer (140, 141, 142, 143, 230, 231, 232) creates at least a partial separation between the wood and concrete.

19 Claims, 2 Drawing Sheets

U.S. PATENT DOCUMENTS

| | | | | |
|---|---|---|---|---|
| 6,955,014 | B2 * | 10/2005 | LeJeune et al. | 52/223.6 |
| 2004/0118063 | A1 * | 6/2004 | Shidler | 52/309.11 |
| 2005/0086906 | A1 | 4/2005 | Bathon et al. | |

FOREIGN PATENT DOCUMENTS

| | | | |
|---|---|---|---|
| DE | 44 06 433 | | 6/1995 |
| DE | 198 05 088 | A1 | 8/1999 |
| DE | 198 08 208 | | 9/1999 |
| DE | 198 18 525 | | 11/1999 |
| DE | 201 19 279 | U1 | 4/2002 |
| DE | 5 773 | U1 | 11/2002 |
| DE | 202 10 714 | U1 | 11/2002 |
| EP | 432484 | A2 * | 6/1991 |
| EP | 0 952 271 | | 10/1999 |
| WO | WO 94/11589 | | 5/1994 |

OTHER PUBLICATIONS

Machine Translation of EP 0952271.*

* cited by examiner

WOOD-CONCRETE-COMPOSITE SYSTEMS

CROSS REFERENCE TO RELATED APPLICATIONS

This application is a continuation application of U.S. Ser. No. 10/970,574 Oct. 21, 2004, now abandoned, of the same title, which claims priority to German Applications no 203 16 376.1, filed Oct, 23, 2003 and no. 103 51 989.0, filed Nov. 7, 2003, the content of which is incorporated by reference thereto.

BACKGROUND OF THE INVENTION

This invention relates to wood-concrete composite systems, which include at least one wooden component, and a concrete component.

Patent DE 44 06 433 C2, the content of which is incorporated herein by reference, discloses wood with inserted bonded shaped parts to connect with materials of any kind. The known connection system includes flat body in form of a steel sheet, which is bonded partially into a wooden component and partially extends beyond the wooden specimen. The exposed section of the connection system serves to connect to further materials.

From the disclosure of DE 198 08 208 A1, the content of which is incorporated herein by reference, it is known to connect wood to concrete by glued-in shaped parts. This known wood concrete composite connection includes flat bodies in form of steel sheets, which are bonded with one end into a slot in the wood and which reach over the wooden surface with the other end. The exposed end of the steel sheet includes anchor tongues, which are then encapsulated by the poured concrete.

From the disclosure of DE 198 18 525 A1,the content of which is incorporated herein by reference, it is known to connect multiple joined boards with an upper concrete layer through steel bars. The composite action between the wood and concrete is created through a shear connector which extends half way into the wooden and concrete section through a mechanical interlock. The shear connectors are oriented perpendicular to the grain of the wooden specimen in order to generate suitable load bearing forces.

In U.S. Pat. No. 5,561,957 to Gauthier, an intermediate layer 10 and 11 is physically located between the wood 1 and the concrete 2. However, this layer 10 and 11 does not separate the wood from the concrete. In other words, Gauthier therefore relies on the fact that the concrete 2 rests directly on the wood 1, thereby suffering from the drawbacks of the prior art.

In PCT application No. WO94/11589 to Bettex, although having what might be considered an intermediate layer 4 and the shear connection 2 between the wood and the concrete, here too, the intermediate layer 4 does not separate the wood and the concrete in the area of the shear connection 2.

A substantial disadvantage of the aforementioned prior art is the unsatisfactory composite action between the materials wood and concrete and the limitations resulting from the direct connection of these materials. It is known that a direct contact between wood and concrete can lead to condensated moisture and thus to fungus growth in the wood.

It is also known that a direct contact between wood and concrete creates a sound coupling, which prevents the serviceability of a wood-concrete composite floor unless further sound insulation elements are added.

A further disadvantage of the aforementioned prior art is the fact that any inserts such as cables and/or pipes into the wood and/or concrete section undergoes stresses which reduce their long term performance.

What is needed is a method of creating a wood concrete composite system which provides for uncoupling of the totally different materials wood and concrete, without reducing the rigid and/or stiff connection—a sole condition for an effective composite action—of the two materials.

SUMMARY OF THE INVENTION

A wood concrete composite system has a wood construction component, at least a single intermediate layer and a concrete construction component. The concrete construction component includes at least one side which faces towards the wood construction component. The at least single intermediate layer creates at least a partial separation between the wood and concrete.

The wood-concrete composite system according to the invention includes wooden construction components, an adjacent concrete construction component and an intermediate layer that creates at least a partial separation and/or uncoupling between the wood and concrete materials. The purpose of the intermediate layers is to at least partly separate and/or uncouple the wood and concrete in geometry, and mechanical, and/or physical (i.e. thermal, sound, vibration) performance. This uncoupling does not however reduce the composite action between wood and concrete substantially.

The rigid connection between the wood and concrete is achieved by gluing at least one end of the connecting devices into the wooden construction components. The other end extends through the intermediate layer and is encapsulated by the concrete section by mechanical friction after the curing of the concrete.

To the surprise of the inventors, it was detected that the composite action can even be increased by connecting two ends of the connection device into the wooden component. The arrangement exhibits both an increase of the stability of the connection device itself and also an increase of the overall composite action.

An object of the invention is to create wood concrete composite systems with intermediate layers which are equipped with high composite action, various cross sections, various system properties and various physical characteristics. The task of the intermediate layer is to provide an element which separates the totally different materials wood and concrete, without reducing the rigid and/or stiff connection—a sole condition for an effective composite action—of the two materials.

In another feature, the wood concrete composite systems according to this invention can be used i.e. as columns, walls, girders plates, floors, frames, portal frames, covers-, roofs-, and/or bridges and are designed to safely withstand mechanical, thermal, chemical penetration and/or loads.

DETAILED DESCRIPTION OF THE PREFERRED EMBODIMENT

Referring now to FIGS. I and 2, the wood concrete composite system 100, 200 according to this invention includes wooden construction components 110, 111, 112, 210, 211, an adjacent concrete construction unit having a side facing the wooden construction components, and a (at least) single intermediate layer that creates at least a partial separation and/or uncoupling between the wood and concrete. The purpose of the intermediate layers is to at least partly separate and/or uncouple the wood and concrete in geometry, and mechanical and/or physical (i.e. thermal, sound, vibration) performance. This uncoupling does however not reduce the composite action between wood and concrete substantially.

The rigid connection between the wood and concrete is achieved by gluing at least one end of the connecting devices 130, 220, 223 into the wooden construction components. The other end extends through the intermediate layer and is rigidly encapsulated in the concrete section by mechanical friction after the curing of the concrete.

Figure 2:
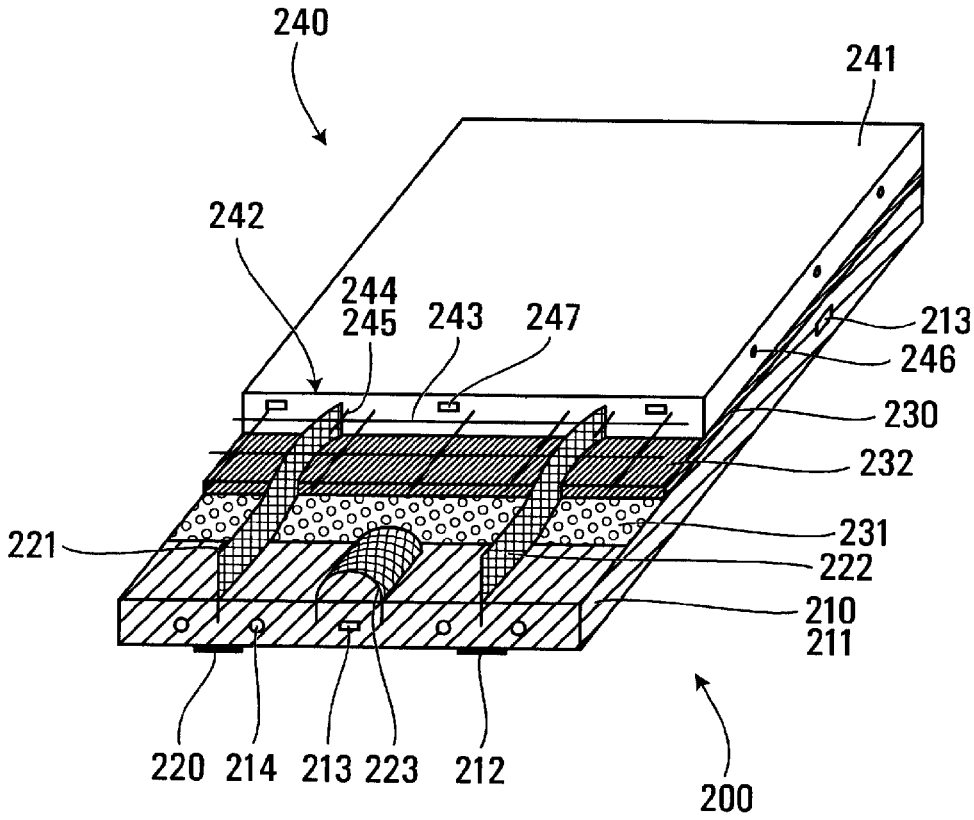
FIG. 2 is a perspective view of a section of another embodiment of the wood concrete composite system of the invention.

Referring in particular to FIG. 2, to the inventors' surprise, it was detected that the composite action can even be increased by connecting two ends of connection device 223 into the wooden component. This results in both an increase of the stability of the connection device itself and also an increase of the overall composite action.

It is up to the user and/or designer to choose a composite action of the connection device with the intermediate layer and/or the intermediate layers. In a further arrangement of the invention it is likewise conceivable that the connecting devices do not exhibit any composite action to the intermediate layers. As such the connection device within the wood construction component transmits no significant force to the intermediate layer.

It is also possible to build a wood-concrete composite system wherein the connection device is connected rigidly to the concrete section by adhesive action.

The connecting devices can be arranged depending upon the particular application in a particular order or arranged chaotically. As used herein, the term "chaotically" is used in the manner that mathematicians use it to describe a state on no order. By way of example, the following arrangements arc possible: one behind the other, one next to each other, spaced apart, lengthwise, arranged crosswise, diagonally, following a curve, swung and/or strewn.

The connection device may be made of flat bodies, lattices and/or nets in straight lines and/or odd forms made out of metals and/or plastics. The connection device can be bent, waved, swung, edged, bent at least partially straight, and/or twisted. The flat bodies can be at least partly punched, bored, roughened up, stretched, pulled and/or distorted.

One arrangement of the wood concrete composite systems uses a hybrid connection device in which the end embedded in the wood is made out of plastic and the end that extends into the intermediate layer and concrete is made of metal.

Another arrangement of the wood concrete composite system could include a variation of the geometries of the connection device itself. This means a change of the form, shape and therefore the mechanical properties of the connection device between the wood, the intermediate layer and the concrete. This would mean that the connection device is used as anisotropic and heterogeneous arrangement.

A further arrangement exhibits an increase in the coupling forces by connecting two or more ends of the connection device into and /or onto the wooden construction components. This also strengthening of the wood concrete composite systems as well as increases the stability of the connection device.

A further arrangement of the composite system includes the addition of teeth, discontinuities and/or bulges positioned over at least part of the surface of the connection device. Surprisingly, these arrangements provide for the positioning and/or an adjustment of the connection device in the appropriate pre-existing openings of the wooden construction components and/or prevent the adhesive from leaking out of its curing location. Thus, the connection device can be glued into the wooden component and then transported, temporarily stored and/or installed on the construction side. This allows for an application in walls and/or overhead.

The connecting devices are fixed by gluing in appropriate openings in the construction components and/or on the construction components. In one embodiment of the invention, the connection device or the construction components may be bonded in this manner, and others glued on the construction components.

The adhesive preferably used is a one or two-component adhesive. Some adhesives (e.g. epoxy resins, PU adhesives) are sensitive to higher temperatures and lose their mechanical properties at approximately 50° C. and higher. This is also known as the "glass transition effect". The glass transition effect describes the phenomenon, in which the adhesive loses its holding ability at a critical temperature under load.

An embodiment of the invention provides for an energy input to the bonding line (adhesive), the connection device itself and/or the neighbouring wood and/or concrete construction units during the curing of the adhesive or at a later time. By doing so, the energy input pushes the critical temperature of the glass transition effect onto a higher temperature level. This increases the overall capacity and security of the composite system. For example, the energy input can be introduced by a stationary and/or mobile heat source (e.g. infrared) locally and/or continuously. Another embodiment of the composite system provides for a heat input through wirings, in the wooden construction components, the intermediate layers and/or the concrete construction units.

The wooden construction components of the wood concrete composite system are made out of planks, boards, girders, beams, plates or formwork. The aforementioned individual components can be used alone or be manufactured from multipart built ups (i.e. box girders). The wooden construction components include grown solid wood, timber materials, engineered wood products and/or wood composite materials. To show the large variety of wooden construction components, here are some examples: Solid wood, resinous wood, hardwood, board laminated wood, veneer laminated wood, veneer strip wood, splinter wood, cement-bound chip boards, chip boards, multi-layer plates, OSB panels, plastic wood composite construction plates, etc.

A further variation of the assembly involves the reinforcement of the wooden construction components and/or the concrete construction units, e.g. by reinforcing with steel and/or plastic, prestressed steel and/or plastic, etc.. These reinforcements can be positioned within the wood and concrete components and/or on the wood and concrete components.

A further range of variations is based on the local strengthening or retrofit of existing wooden construction components by reinforcement, bypassing, prestressing.

A further range of solutions is based on the creation of cavities and/or channels within the wooden construction components, the intermediate layers and/or concrete construction units. The cavities can be produced, for example, by pipes, balls, channels and/or hoses. The lines can be produced exemplarily by cables, pipes, channels and/or hoses.

A further variation of the invention is based on pre-deformation (e.g. increased height, bend, curvature and/or preloading) of the wooden construction components, the intermediate layers and/or the concrete construction units before or after the composite is assembled. The pre-deformation compensates at least partial deformations the composite structure will undergo in its lifetime.

The following example will show the benefit of the pre-deformation of the composite system: given a single span system with a mid support for the wooden member thus allows for a negative predeformation (uplift) once the concrete is cured and the midspan support is reduced, a deflection of the dead loads is compensated by the negative pre-deformation.

The intermediate layers can be used in various materials e.g. in the form of liquid, solid and/or gaseous condition and applied e.g. through layouts, pouring, painting, injecting, and/or foaming. A single intermediate layer consists, for example, of a plastic foil, an impregnated paper, a bitumen pasteboard, a plastic insulating layer, a mineral insulating layer, an organic insulation material, a regenerating insulating material and up-poured and/or applied materials, which tie and/or harden at a later time, e.g. tar, adhesive, plastic mixtures. Further forms of the single intermediate layers includes all mineral and/or mineral bound materials (e.g. mineral bound light-weight pre-cast plates, mineral-bound and insulated sheets) as well as metallic materials (e.g. trapezoidal sheet metals, sandwich components). The multi-layer levels are a combination of the single chaotic intermediate layers described before and/or arranged. The choice between a single intermediate layer and/or multi-layer depends thus only on the requirements to the wood concrete composite systems.

The range of types of concrete suitable for the concrete construction unit includes normal concrete, high-strength concrete, pre-stressed concrete, composite concrete, light-weight concrete, aerated concrete and/or asphalted concrete. It may be useful to add non-mineral additives to the concrete mixture, e.g. plastics, polystyrene and/or wood. The production of the concrete construction units is possible in pre-fabricated form or on the building site.

Furthermore the concrete construction units could be partially manufactured on the construction site and partially on the erection site. Furthermore, the concrete construction units could be partially prefabricated and partially poured on site.

A preferred embodiment includes reinforcement (e.g. steel reinforcement and/or plastic, prestressed steel and/or plastic) of the concrete construction units. The reinforcement allows for a higher stresses to be supported by the concrete construction unit.

A further embodiment involves the production of cavities (e.g. by pipes, balls, blocks and/or channels) for weight reduction and/or for the additional introduction of openings for additional pre-loading devices. A still further embodiment involves the addition of openings (e.g. cables, pipes, channels and/or hoses) within the concrete construction units, which allow the use of electricity, heat, technical and/or supply lines.

To the surprise of the inventors, it was discovered that the aforementioned openings can be used as heating supply units to heat up the wood concrete composite systems and create thereby a state that improves the glass transition temperature of the used adhesives (for the anchorage of the connection device in the construction components).

A further embodiment of the invention includes optionally combining multiple layers of wooden and concrete construction units as well as intermediate layers mixed within each other. For better comprehension, for example, one could built a wall having a wooden unit on the outside and a concrete unit in the inside wherein two intermediate layers separate the concrete and wood.

The wood concrete composite systems according to this invention can be used, for example, as columns, walls, girders plates, floors, frames, portal frames, covers, roofs, and/or bridges. In this manner, they may be designed to withstand mechanical, thermal, chemical penetration and/or loads safely.

Figure 1:
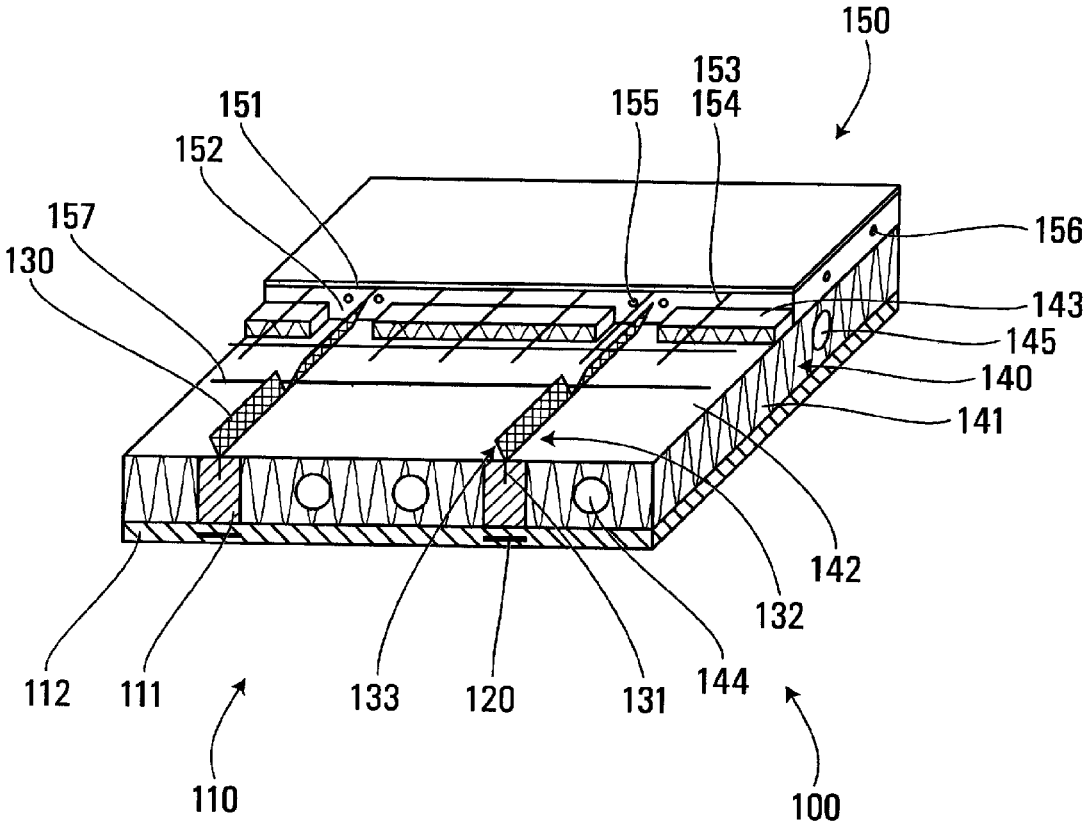
FIG. 1 is a perspective view of a section of the wood concrete composite system of the invention.

Referring now to FIG. 1, an example of a section of the wood concrete composite system 100 is shown, which, by way of example, is represented as a floor, wall, and/or roof system. The system could be referred to as a box-system.

The wood concrete composite system 100 includes wooden construction components 110, shown as two beams 111 and a timber panelling 112. The beams 111 are connected to the timber panelling 112 rigidly through adhesive action. The timber panelling 112 holds two local reinforcements 120 in the shape of plastic fibre mesh.

Four connection devices 130 are shown. They are manufactured as punched and distorted flat bodies (also known as stretched metal sheets) 131 made of metal, which show a bend 132 at half height. The bend 132 is altered in the longitudinal direction and creates a forking 133 in form of a Y (forking 133 appears with a front view in longitudinal direction).

Again, by accident, it was discovered that the bend improves the positioning of the connection device 130 within the channel it is glued in. Furthermore, it reduces the risk of a crack forming within the concrete construction component 150 due to the peak load introduced by the connection device 130. Furthermore, the forking 133 provides a position to place additional steel reinforcement bars (not represented here) which increase the overall carrying capacity of the composite system.

The intermediate layer 140 includes a (form-stable) mineral wool 141 positioned between the beams 111 and on the timber panelling 112. On top of the mineral wool 141, there is a diffusion-open foil 142, which covers the timber beams 111 and at the same time, extends toward the connection devices 130. The intermediate layers 140 which are shown as a mineral wool 141 have cavities 144 and 145 in a cross-sectional and longitudinal direction, which serve as supply channels.

It was further learned serendipitously, that the tubular cavities 145 can be manufactured right through the timber beam l11 due to the increase of the overall strength created by the composite action. Therefore, it can be shown that the composite action compensates local weakening of the beam 111.

A further component of the intermediate layers 140 is represented by "STYROFOAM" section 143, which is located on the foil 142 between the timber beams 111 within the concrete construction units 150. "STYROFOAM" is a trademark name for what is otherwise generically rigid, light-weight, polystyrene plastic insulating board.

The concrete construction unit 150 is shown as a continuous plate 151 with rib-like expansions 152 in the range of the connection device 130. The concrete construction unit 150 has reinforcements 153 in the form of reinforcing steel mats 154, which rest on the connection device 130. The concrete construction unit 150 shows further cavities 155 and lines 156, which respectively serve as a heat supply and a subsequent reinforcement of the concrete construction units 150. The cavities 155 allow for the introduction of appropriate prestressed steel units, in order to provide an additional reinforcement means in order to improve serviceability.

The lines 156 serve as a heater to increase the material-conditioned glass transition temperature of the adhesive and therefore increase the total load-carrying capacity of the wood concrete composite system 100.

The concrete construction units 150 hold further reinforcements 157 in the form of reinforcing steel bars, located between the connection devices 130. The reinforcing steel bars 157 serve to handle additional stress peaks, which can occur in the proximity of the connection device 130. In addition, this creates another interlock between the connection device 130 and the concrete construction unit 150.

Another increase in serviceability can be achieved by guiding the reinforcement steel bar 157 through the opening (e.g. expanded metal openings) of the connector devices 130.

Tile wood concrete composite system 100 may be manufactured at the building site as a floor system. First the individual construction components (e.g. wooden construction component 110, intermediate layers 140) are positioned with a negative bending through a mid-span support. After the curing of the concrete on the site, the mid-span support is removed. Due to the negative deflection, the composite beam may now serve essentially as a straight beam due to the natural deflection given by the dead load a life load of a structural system.

Referring now to FIG. 2, an example of a section of the wood concrete composite system 200 is shown, which, for example, represents a bridge structure or floor system. The system could be referred to as a slim-floor-system.

The wood concrete composite system 200 includes wooden construction component 210, shown as a glulam plate 211 with an external reinforcement 212 in the form of carbon fibre reinforcement which is rigidly connected to the glulam plate 211 by adhesive action. The glulam plate 211 shows exemplarily cavities 213 and lines 214, which respectively are used for electrical supply and heat supply units. The cavities 213 accommodate the introduction of appropriate electrical cable lines which are enclosed within the wood concrete composite systems 200. The lines 214 serve as heating pockets for the adhesive used to glue the connection devices 220 within the glulam plate 211. The heating increases the material-conditioned glass transition temperature of the adhesive and thereby increases the load-carrying capacity of the connection device 220 within the glulam plate 211.

The connection devices 220 are exemplarily shown as curved form-stable plastic meshes 221 and curved metal lattices 223. The metal lattices 223 are used exemplarily in a section of the wood concrete composite system 200 where high shear forces are expected.

The plastic meshes 221 reach approximately one third of their height into the glulam plate 211 and are secured through adhesive action. The plastic mesh 221 was designed in such a way that the portion that reaches into the glulam plate 211 and the intermediate layer 230 has smaller openings 222 (compared to the openings within the concrete section 240) to create higher stiffness values within the intermediate layer 230 (which provides no support) and fewer openings within the glulam plate 211 to reduce the need for the use of adhesive.

The curved shape of the plastic meshes 221 surprisingly creates additional specimen stability and increases the mechanical friction/connection teeth between the glulam plate 211 and concrete unit 240.

Two ends of the metal lattices 223 arc exemplarily embedded (within pockets in form of slots) into the glulam plate by adhesive action. This procedure provides a high degree of rigidity within the metal lattice 223 as well as a high degree of connection stiffness between the glulam plate 211 and concrete unit 240. The metal lattice 223 includes a bulge (here not shown) on the cutting edge between the glulam plate 211 and the intermediate layer 231 to prevent the adhesive from withdrawal.

The intermediate layers 230 include, for example, a multilayer bitumen (painted on) with embedded plastic foil 231 and a PU foam layer 232 on top. The PU foam layers 232 includes individual panels which are placed individually on top of the plastic foil 231.

By way of example, the concrete construction unit 240 is a continuous plate 241. The concrete construction unit 240 has a reinforcement 242 in the form of reinforcing steel mats 243, which rest, by way of example, only on the connection device 220. In addition, the concrete plate 241 holds a local reinforcement 244 in the form of a reinforcing steel bar 245 which will be connected to the plastic mesh 221 (for example, by wire) prior to the assembling of the reinforcing steel mats 243 and the pouring of the concrete.

The concrete construction unit 240 holds cavities 246 and lines 247, which respectively provide subsequent reinforcement and climate control supply for the concrete construction unit 240.

The cavities 246 provide for the introduction of appropriate pre-loaded steels in order to allow a subsequent reinforcement of the concrete construction unit 240. The location of the cavities 246 depends on the structural requirements and can, for example, be on top, between and/or adjacent to the connection device 220 (shown as reference numbers 221 and 223).

The lines 247 allow, for example, the coupling to an appropriate central air-conditioning unit to create an adequate heating and cooling supply for the wood concrete composite system 200 and its environment. Thus, for example, energy-saving solutions are made possible for the above private commercial and industrial buildings.

By way of example, the wood concrete composite system 200 was prefabricated as one construction element and transported and installed on the job site to create an overall floor system. The prefabrication permits therefore a rapid production of the building without introducing humidity (e.g. because of otherwise having to pour wet reinforced concrete on sight) into the wood concrete composite system 200 and/or buildings.

The individual wood concrete composite systems 200 can be connected with each other during erection time or at a later time. In this way also diaphragm effects can be achieved with segmented wood concrete composite systems 200.

In an advantage of the invention, the wood-concrete composite system has an intermediate layer which exhibits high composite action.

In another advantage, the wood-concrete composite system provides for separation of the totally different materials wood and concrete materials, by means of a bonded intermediate layer of rigid material, thus providing for effective composite action while reducing the negative characteristics associated with a direct wood-concrete connection.

In another advantage, the wood concrete composite systems according to this invention can be used as columns, walls, girders plates, floors, frames, portal frames, covers, roofs, and/or bridges and may be designed to safely withstand mechanical, thermal, or chemical penetration.

In another advantage, the intermediate layer increases the stiffness of the wood-concrete composite system as it is well known that the rigidity of a structural cross section increases with an increasing height due to an increasing lever arm.

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed is:

1. A wood concrete composite system (100, 200) coupling wood and concrete, the system being a load bearing structural component and comprising:

a wood construction component (110, 111, 112, 210, 211), an at least single intermediate layer (140, 141, 142, 143, 230, 231, 232), a concrete construction unit (150, 151, 152, 240, 241), and at least one laterally elongated connection device (130, 220, 223) formed of flat, thin metal having an array of holes/openings formed therein, the connection device supporting composite action between the wood construction component (110, 111, 112, 210, 211), and the concrete construction unit (150, 151, 152, 240, 241), which connection device is adhered to and embedded in laterally elongated openings of the wood construction component such that at least a portion of the array of holes/openings is located entirely within the laterally elongated openings, which connection device passes through the intermediate layer (140, 141, 142, 143, 230, 231, 232) and is embedded in the concrete construction unit, wherein at least one side of the concrete construction unit (150, 151, 152, 240, 241) faces towards the wood construction component (110, 111, 112, 210, 211), and the at least single intermediate layer (140, 141, 142, 143, 230, 231, 232) is interposed between the wood construction component and the concrete construction unit so as to prevent direct contact between the wood and concrete while allowing composite action therebetween, wherein further the connection device includes a forking at approximately its half-height.

2. The wood concrete composite system of claim 1, wherein the forking forms a Y-shape.

3. The wood concrete composite system (100, 200) of claim 1 wherein the wood construction component (110, 111, 112, 210, 211) comprising at least one element selected from a group of elements consisting of planks, boards, girders, beams, plates or formwork and/or a composition of the aforementioned elements.

4. The wood concrete composite system (100, 200) of claim 1 wherein the wood construction component (110, 111, 112, 210, 211) is made out of at least one of a group of materials consisting of grown solid wood, timber materials, engineered wood products and wood composite materials.

5. The wood concrete composite system (100, 200) of claim 1 wherein the wood construction component (110, 111, 112, 210, 211) has reinforcement 120 made of steel and/or plastic.

6. The wood concrete composite system (100, 200) of claim 1 wherein the wood construction component (110, 111, 112, 210, 211) uses further means selected from a group of means consisting of reinforcement and prestressing, to overcome the natural and/or technical weak points of the construction components (110, 111, 112, 210, 211).

7. The wood concrete composite system (100, 200) of claim 1 wherein the wood construction component (110, 111, 112, 210, 211) has a pre-loading prior to assembling of the intermediate layers (140, 141, 142, 143, 230, 231, 232) and/or concrete construction unit (150, 151, 152, 240, 241), the pre-loading can be achieved through a negative deflection, and/or a bending prior to assembly and therefore compensates possible deflections that occur during the lifetime of the system.

8. The wood concrete composite system (100, 200) of claim 1 wherein at least two intermediate layers (140, 141, 142, 143, 230, 231, 232) are used which are loosely interconnected.

9. The wood concrete composite system (100, 200) of claim 1 wherein the intermediate layers (140, 141, 142, 143, 230, 231, 232) are: rolled on, poured, painted and/or injected and applied as firm, liquid or gaseous material at a given time.

10. The wood concrete composite system (100, 200) of claim 1 wherein the intermediate layer (140, 141, 142, 143, 230, 231, 232) has cavities (144, 145, 155, 246), channels or passages, wherein lines, cables, hoses, and/or pipes, may pass, and which further create a weight reduction.

11. The wood concrete composite system (100, 200) of claim 1 wherein the concrete construction unit (150, 151, 152, 240, 241) is made out of one of a group of concrete types consisting of ordinary concrete, high-strength concrete, prestressed concrete, composite concrete, lightweight concrete, aerated concrete and asphalted concrete which may hold additional non-mineral additives selected from a group of additives consisting of plastic, polystyrene, and wood.

12. The wood concrete composite system (100, 200) of claim 1 wherein the concrete construction unit (150, 151, 152, 240, 241) is manufactured on the construction site, is prefabricated prior to erection, or partially fabricated on the construction site and partially pre-fabricated.

13. The wood concrete composite system (100, 200) of claim 1 wherein the concrete construction unit (150, 151, 152, 240, 241) has a steel and/or plastic reinforcement (153, 154, 157, 243, 244, 245), cavities (155, 246), and/or lines (156, 247).

14. The wood concrete composite system (100, 200) of claim 10 wherein the cavities (155, 246) supply heating to overcome the glass transition temperature of the adhesive used to anchor the connection device (130, 220, 223).

15. The wood concrete composite system (100, 200) of claim 1 wherein multiple layers of wood construction components (110, 111, 112, 210, 211), intermediate layers (140, 141, 142, 143, 230, 231, 232) and concrete construction units (150, 151, 152, 240, 241) are combined to create a layered composite system that allows a broader variety of applications.

16. The wood concrete composite system (100, 200) of claim 1 further comprising: at least one of a group of components consisting of columns, walls, girders plates, floors, frames, portal frames, covers, roofs, and bridges for the purpose of withstanding mechanical, thermal, chemical penetration or loads.

17. The wood concrete composite system (100, 200) of claim 13, wherein the steel or plastic reinforcement (153, 154, 157, 243, 244, 245), cavities (155, 246), and/or lines (156, 247) are prestressed.

18. The wood concrete composite system (100, 200) of claim 1, wherein the at least single intermediate layer (140, 141, 142, 143, 230, 231, 232) is made of a form-stable mineral wool.

19. The wood concrete composite system (100, 200) of claim 1, wherein the connection device (130, 220, 223) comprises a sheet material in the form of a mesh.

* * * * *